US007819396B2

(12) United States Patent
Kuo et al.

(10) Patent No.: US 7,819,396 B2
(45) Date of Patent: Oct. 26, 2010

(54) SHEET SEPARATING APPARATUS AND METHOD OF SEPARATING SHEETS

(75) Inventors: Youti Kuo, Penfield, NY (US); Kenneth W. Luff, Walworth, NY (US); Ernest L. DiNatale, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 398 days.

(21) Appl. No.: 11/213,044

(22) Filed: Aug. 25, 2005

(65) Prior Publication Data

US 2007/0045936 A1 Mar. 1, 2007

(51) Int. Cl.
*B65H 3/34* (2006.01)

(52) U.S. Cl. ..... 271/42; 271/104

(58) Field of Classification Search ..... 271/124, 271/42, 121, 94, 104
See application file for complete search history.

(56) References Cited

U.S. PATENT DOCUMENTS 4,896,872 A * 1/1990 Sardella ..... 271/11
5,435,540 A * 7/1995 Martin et al. ..... 271/122
5,927,706 A * 7/1999 Hiroi et al. ..... 271/117
5,971,389 A * 10/1999 Golicz et al. ..... 271/34
6,193,231 B1 * 2/2001 Hannon ..... 271/138
6,224,049 B1 * 5/2001 Hosking et al. ..... 271/10.03
6,224,052 B1 * 5/2001 Nagano ..... 271/127
6,378,858 B1 * 4/2002 Suga ..... 271/10.01
6,425,578 B1 * 7/2002 Wood et al. ..... 271/37
6,540,220 B2 * 4/2003 Kuo et al. ..... 271/118
6,641,132 B2 * 11/2003 Sekine ..... 271/124
6,672,579 B2 * 1/2004 Araki et al. ..... 271/122
6,824,131 B2 * 11/2004 Togashi ..... 271/121

* cited by examiner

*Primary Examiner*—Saúl J Rodríguez
*Assistant Examiner*—Howard Sanders
(74) *Attorney, Agent, or Firm*—Marger Johnson & McCollom, P.C.

(57) ABSTRACT

A sheet separating mechanism and a method of separating sheets that includes a retard surface carrier that causes a retard surface to apply an alternately higher and lower friction force against the edge of an underlying sheet. The alternation of the higher and lower friction force can be coupled to a vacuum sheet feeder. The retard surface can be translated to present a next portion of the retard surface to the edge of the next underlying sheet with the translation coupled to the vacuum sheet feeder.

11 Claims, 5 Drawing Sheets

FIG. 4
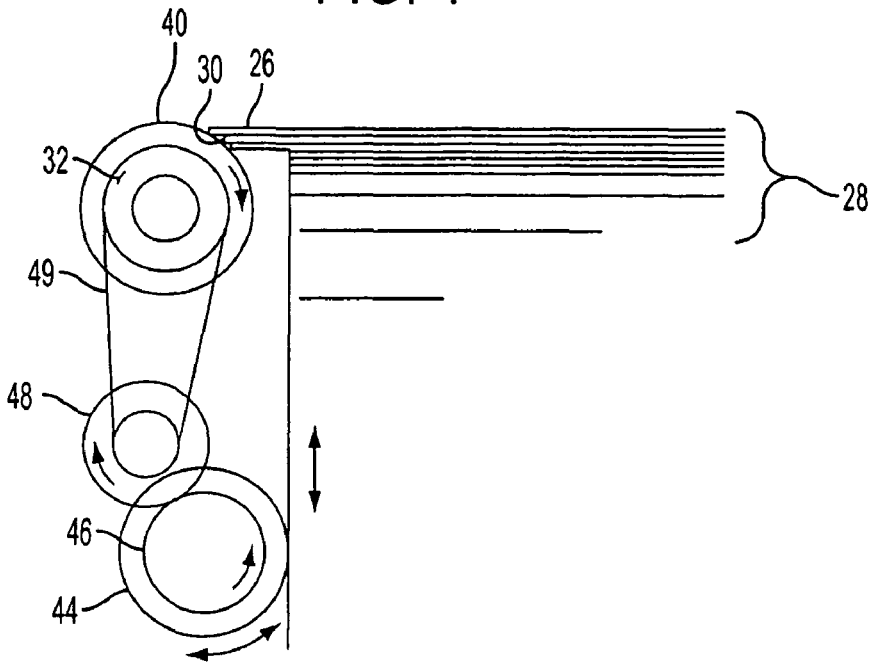
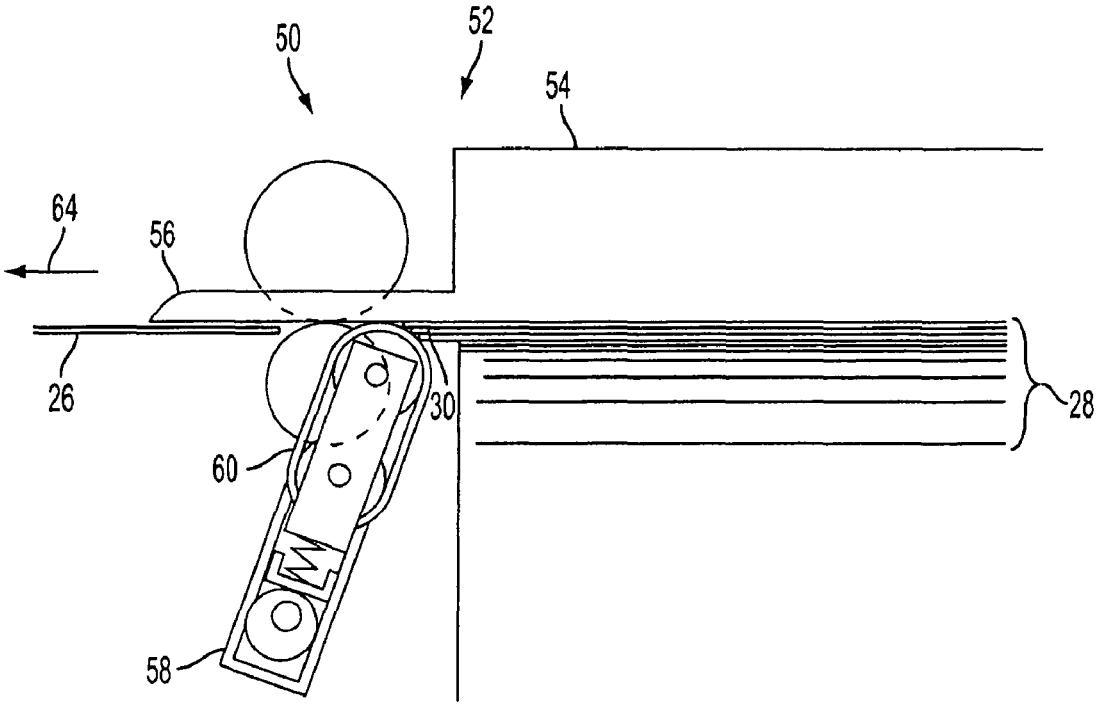
FIG. 5

SHEET SEPARATING APPARATUS AND METHOD OF SEPARATING SHEETS

TECHNICAL FIELD

This disclosure is related to the feeding of sheets in a printer or copier and more particularly to preventing multi-feeds of sheets.

BACKGROUND

Multifeeds of sheets in a printer or copier can be typically caused by welding of sheet edges, porosity of sheets, adhesion and static charge between sheets. A vacuum sheet feeding system can reduce some but not all multifeeds of sheets. When multifeeds do occur, the multiple sheets can jam the printer or copier forcing an operator to fix the jam and possibly even damaging the printer or copier.

One way to provide a sheet separating force is to position a stationary rubber pad at the edge of the stack of feeding sheets. The stationary rubber pad provides a static friction force against the leading edge of the underlying sheet or sheets. As the top sheet is fed into the printer or copier, if the underlying sheets follow the top sheet, the stationary pad blocks the path of the underlying sheet or sheets.

SUMMARY OF THE DISCLOSURE

A sheet separating mechanism and a method of separating sheets is provided to prevent multi-feeds of sheets into printers or copiers. As a top sheet is fed from a stack of sheets by a sheet feeding system, the sheet separating mechanism applies an alternately higher and lower friction force from a portion of a retard surface against the edge of the underlying sheet. While the top sheet is fed, the higher friction force is applied. After the top sheet is fed, the lower friction force is applied. Alternating the higher and lower friction force can be coupled to the motion of the sheet feeding system.

The sheet separating mechanism can translate the retard surface to position a next portion of the retard surface for contacting the edge of the next sheet, with the translation of the retard friction surface coupled to the motion of the sheet feeding system. The translatable retard friction surface can be a relatively high friction surface on a roller and can be a relatively high friction surface of a belt.

BRIEF DESCRIPTION OF THE DRAWINGS

FIG. 4 is side elevation depiction of the sheet feeding system of FIG. 1 showing a sheet separating mechanism drive configuration.

FIG. 5 is a side elevation view of another sheet feeding system including a sheet separating mechanism.

DETAILED DESCRIPTION

Figure 1:
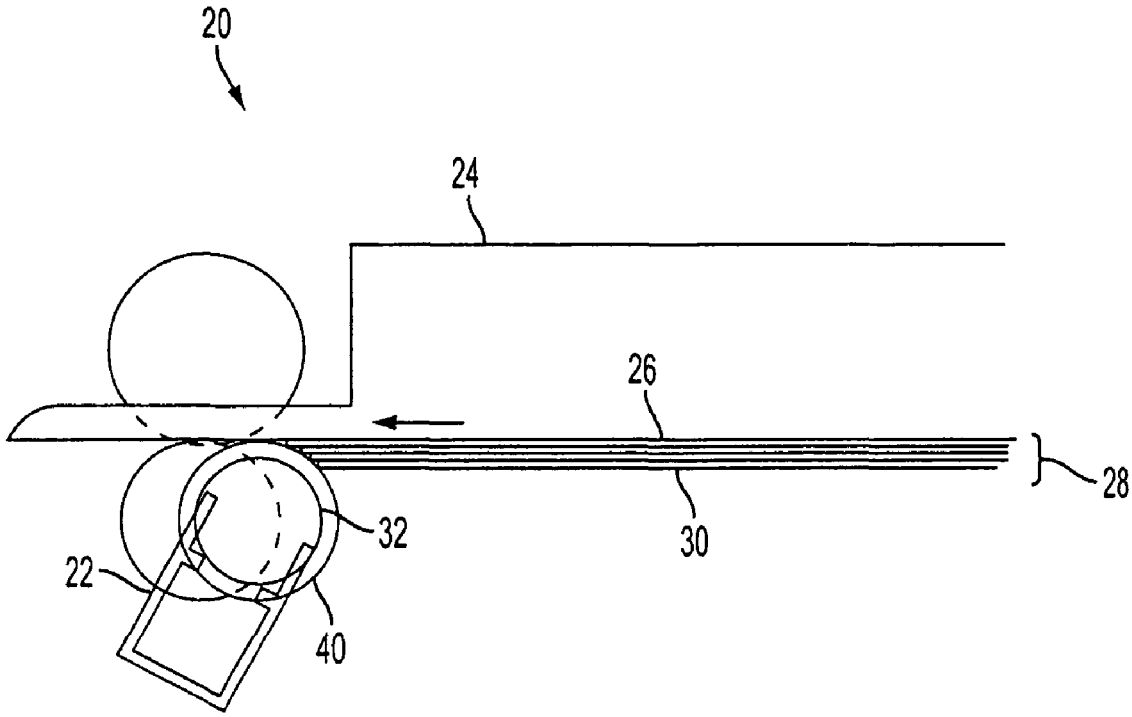
FIG. 1 is a side elevation view of a sheet feeding system including a sheet separating mechanism.

FIG. 1 shows a side elevation view of sheet feeding system 20. Sheet separating mechanism 22 is positioned below vacuum feed head shuttle 24 which can be arranged to feed a top sheet 26 from stack of sheets 28. The sheet separating mechanism 22 can be positioned to apply a friction force against underlying sheet 30 while the shuttle 24 feeds the top sheet 26 to a printer or copier (not shown).

The sheet separating mechanism 22 includes a retard roller 32 with retard surface 40 (see FIG. 3) mounted on the retard roller 32. The sheet separating mechanism positions the retard surface 40 such that a first portion of the retard surface 40 contacts an edge of the underlying sheet 30. The sheet separating mechanism is structured to rotate the retard roller 32 after top sheet 26 is fed from the stack 28 to present a next portion of the retard surface 40 for contacting the next underlying sheet.

Figure 2:
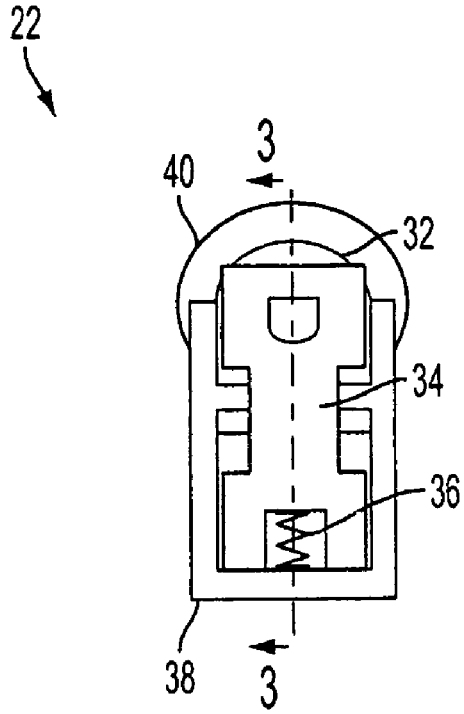
FIG. 2 is a side elevation view of the sheet separating mechanism of FIG. 1.
Figure 3:
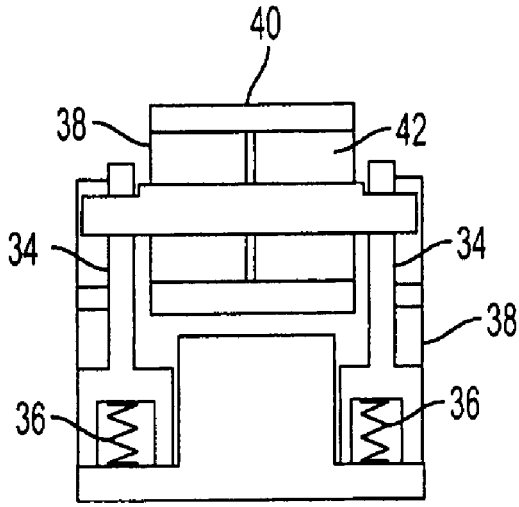
FIG. 3 is a cross-sectional view of the sheet separating mechanism of FIG. 2 taken along line 3-3 in FIG. 2.

Referring to FIGS. 2 and 3, the retard roller 32 is mounted on side plates 34 that are supported by springs 36 in support frame 38. The retard surface 40 on retard roller 32 can be made of a relatively high friction material and may be made of rubber. One-way clutch 42 allows the retard roller 32 to rotate from the first contact position in a single direction to present the next portion of retard surface 40 to contact the next sheet in the stack 28.

FIG. 4 shows one configuration for driving the rotation of the retard roller 32. Two outer rolls 44 contact an edge of paper stack 28 or a tray (not shown) containing paper stack 28. After top sheet 26 is fed from the stack 28, the stack 28 moves up to present the next sheet for feeding. The movement of the stack 28 causes the retard roller 32 to roll and position a next portion of the retard surface 40 for contacting the next sheet. Rolling of the retard roller 32 occurs because the upward movement of the stack 28 rotates the contacting outer rolls 44 which in turn rotate inner roll 46 which contacts intermediate roll 48. The inner roll 46 may include a one-way clutch (not shown) to allow the inner roll 46 to rotate in a single direction or the one-way clutch 42 may be built into the sheet separating device 22 as shown in FIG. 3. The rotating inner roll 46 rotates the contacting intermediate roll 48 which, in turn, rotates the retard roller 32 by connecting belt 49.

The retard surface 40 contacts an edge of the underlying sheet 30. Because some printers or copies do not utilize a small outer portion at the border of the sheet surface in their respective printing processes, the retard surface 40 can be positioned to contact a portion at the border of the surface of the next sheet 30 adjacent to the lead edge of next sheet 30. To avoid smudging, the amount of the surface contacted by the retard surface 40 can be a portion of the surface within about 3 millimeters (mm) from the edge of the sheet 30.

FIG. 5 shows a side elevation view of sheet feeding system 50. System 50 includes a vacuum sheet feeder 52 that includes vacuum feed head shuttle 54 and shuttle lead plate 56. While vacuum sheet feeder 52 is shown in FIG. 5, other sheet feeding mechanisms are contemplated to be within the scope of this disclosure. System 50 also includes sheet separating mechanism 58 which includes a retard belt 60 that has a relatively high friction surface.

Vacuum sheet feeder 52 feeds top sheet 26 from the stack of sheets 28 in a feed direction 64 away from the stack 28. The sheet separating mechanism 58 is positioned such that the retard belt 60 contacts the edge of the underlying sheet 30. The surface of the retard belt 60 applies a friction force to the edge of the underlying sheet 30 in a direction generally opposite the feed direction 64. After the vacuum sheet feeder feeds a top sheet 26, the retard belt 60 is driven by the retracting shuttle lead plate 56 to travel opposite to the feed direction such that a next portion of the retard belt 60 is positioned to contact the next underlying sheet.

Figure 6:
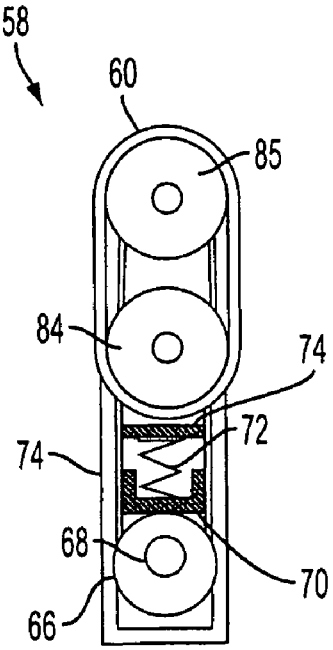
FIG. 6 is a side elevation view of the sheet separating mechanism of FIG. 5 showing the spring in an uncompressed position.
Figure 7:
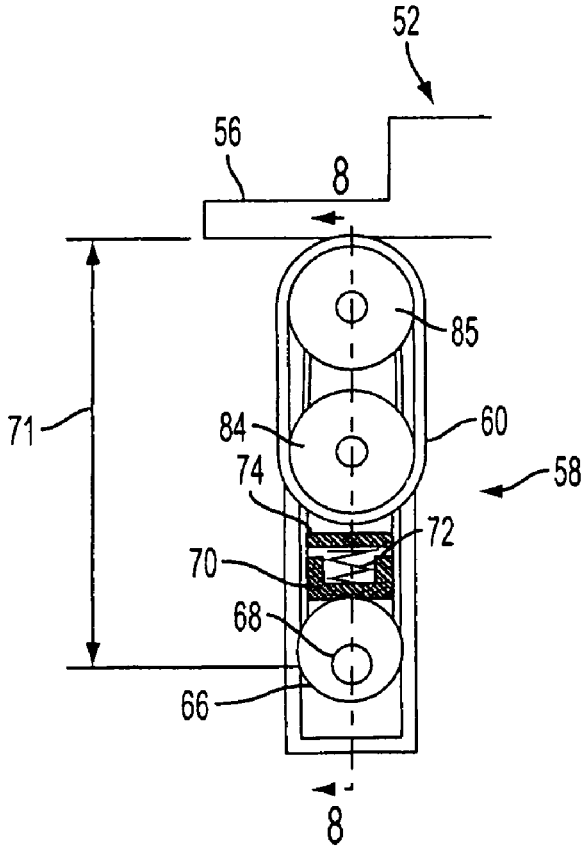
FIG. 7 is a side elevation view of the sheet separating mechanism of FIG. 5 showing the spring compressed by the cam follower.
Figure 8:
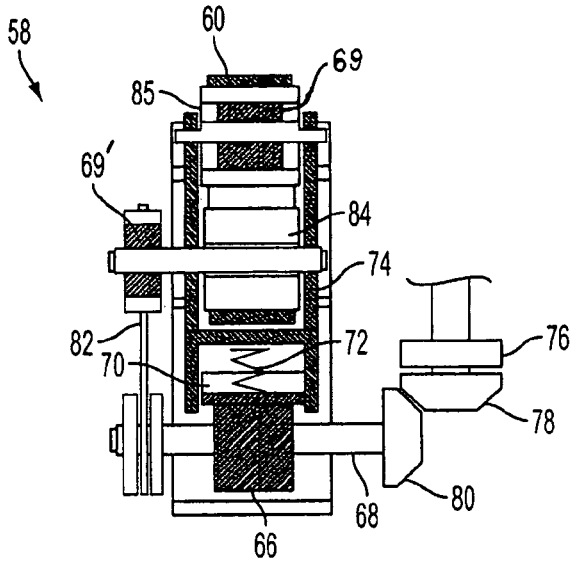
FIG. 8 is a cross-sectional view of the sheet separating mechanism of FIG. 7, taken along line 8-8 in FIG. 7, showing a drive configuration.

Referring to FIGS. 6-8, the sheet separating mechanism 58 includes retard belt 60 which can be made from a relatively high friction material such as rubber. Drive cam 66 rotates around drive shaft 68 and alternatingly pushes cam follower 70 up and down against spring 72 which exerts an alternatingly high and low spring force against belt frame 74. The drive shaft 68 is shown to be driven by drive source gear 76 that engages the drive shaft 68 with bevel gears 78 and 80. The drive shaft 68 drives the retard belt 60 with O-ring belt 82 connected to the shaft of lower pulley 84. One-way clutch 69 allows the retard belt 60 to travel in a single direction around lower and upper pulleys 84 and 85.

FIG. 6 shows the sheet separating mechanism 58 in a low force position. Drive cam 66 is positioned on drive shaft 68 to allow the cam follower 70 to be in a lower position thereby allowing the spring 72 to be uncompressed. This low force position of the drive cam 66 occurs when the vacuum sheet feeder 52 is moving in a direction opposite the feed direction 64, moving back into position to feed a next sheet.

FIG. 7 shows the sheet separating mechanism in a high force position. The drive source gear 76 (coupled to the motion of the vacuum sheet feeder 52) and the drive shaft 68 are adapted to rotate the drive shaft a half turn as the vacuum sheet feeder 52 moves in the feed direction 64 during feeding of top sheet 26. The rotation of the drive shaft 68 rotates drive cam 66 through a position that forces the cam follower 70 up against the spring 72 and thereby pushes the belt frame up against the edge of the underlying sheet 30 while the top sheet 26 is being fed. The one-way clutch 69' prevents O-ring belt 82, shown in FIG. 8, from turning retard belt 60 when the drive shaft 68 is driven in this direction.

Referring again to FIGS. 6-8, upon completion of the feeding motion, the return motion of the vacuum sheet feeder 52 is coupled to the drive shaft 68 and reverses the rotation of the drive shaft 68. The reversed rotation returns the drive cam 66 to the low force position and the one-way clutch 69' allows the O-ring belt 82 to translate the retard belt 60 to position a next portion of the retard belt 60 to contact the next underlying sheet in the stack.

As noted in FIG. 7, the sheet separating mechanism 58 can be positioned on the vacuum sheet feeder 52 such that the distance 71 between the drive shaft 68 and the shuttle lead plate 56 remains fixed.

The spring 72 allows for tighter control of the retard nip force of the retard belt 60 against the underlying sheet 30 by allowing for the variation in force and for any tolerance stack issues in the assembly. Thus, the next sheet will be contacted during the high force period in a surface area about 3 mm within the leading edge of the underlying sheet 30, thereby preventing smudging of the underlying sheet 30 by avoiding contact with the active print area of the sheet. Control of the vacuum force of the vacuum sheet feeder 52 can be difficult, therefore, the sheet feeding system 50, shown in FIG. 5, allows for wider latitude in vacuum force by more easily and precisely controlling the retard nip force of the retard belt 60.

At the low force position shown in FIG. 6, the retard nip force is predetermined to be below a sheet marking threshold. At the high force position shown in FIG. 7, the retard nip force is set for sheet separation, which can be at about 1 pound of force.

Figure 9:
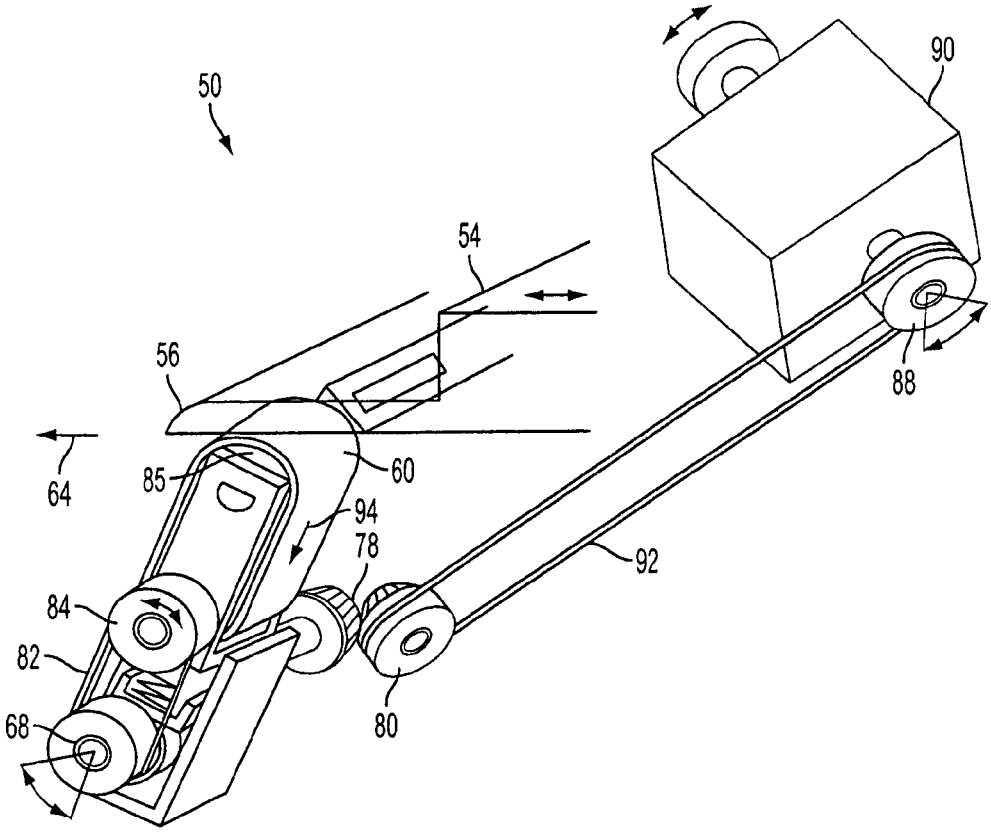
FIG. 9 is a perspective view of the sheet feeding system of FIG. 6 showing the sheet separating mechanism being driven by the shuttle drive motor.

FIG. 9 shows a perspective depiction of the sheet feeding system 50. The vacuum feed head shuttle 54 and shuttle lead plate 56 operate to feed a top sheet 26 (see FIG. 5) in a feed direction 64 away from the stack of sheets 28. A drive pulley 88 mounted on the vacuum feed shuttle drive motor 90 drives bevel gear 80 with O-ring belt 92. Bevel gear 80 drives bevel gear 78 on drive shaft 68. Drive shaft 68 rotates drive cam 66 (see FIGS. 6-7) to a high force position when the shuttle drive motor 90 drives vacuum feed head shuttle 54 in the feed direction. When the shuttle drive motor 90 returns the vacuum feed head shuttle 54 in the opposite direction of the feed direction 64, the drive shaft rotates drive cam 66 to a low force position and drives O-ring belt 82 to move retard 60 around the upper and lower pulleys 85 and 84 in direction 94 such that a next portion of the retard belt 60 is positioned to contact the next underlying sheet 30 during the next feed cycle. By coupling the drive shaft 68 to the shuttle drive motor 90, the timing of the high and low nip force against the next sheet 30 and the timing of repositioning the belt 60 is coupled to the timing of the feeding of the top sheet 26.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A sheet separating apparatus for a sheet feeder, comprising:

a translatable retard surface; and a retard roller arranged to position a first portion of the retard surface to contact an edge of a non-feeding sheet in a stack of sheets; and a contacting roller in contact with non-feeding sheets in the stack of sheets, the contacting roller arranged to roll in response to movement in the stack of sheets caused by a sheet feeding motion in the sheet feeder, the contacting roller coupled to the retard roller so as to translate the retard surface to position a next portion of the retard surface to contact an edge of a next non-feeding sheet.

2. The apparatus of claim 1, in which the retard surface is a belt and the retard surface carrier is adapted to translate the belt on a belt pulley.

3. The apparatus of claim 1, in which the retard surface carrier includes a one-way clutch adapted to allow the retard surface to translate in single direction.

4. A paper feeding system, comprising:

a sheet feeding head having a vacuum shuttle configured to move in a feed direction and a direction opposite the feed direction, the vacuum shuttle adapted to feed a top sheet from a stack of sheets in a feed direction during the feed motion;

a drive shaft coupled to the sheet feeding head and arranged so that when the vacuum shuttle moves a rotation of the drive shaft occurs; and a sheet retarding device coupled to the drive shaft such that when the drive shaft rotation occurs, the sheet retarding device is arranged to translate.

5. The system of claim 4, in which the higher force is about 1 pound of force.

6. The paper feeding system of claim 4, the sheet retarding device including a drive cam and spring arranged to apply an alternately higher and lower retard force to an edge of an underlying sheet, the cam arranged to compress the spring with more force during movement of the shuttle in the feed direction than during the movement of the shuttle in the direction opposite the feed direction.

7. The system of claim 4, in which the sheet retarding device includes a friction surface positioned to have a first portion of the friction surface contact the edge of the underlying sheet; and a next portion of the friction surface contact an edge of a next underlying sheet when the sheet retarding device translates opposite the feed motion.

8. The system of claim 7, in which the friction surface is on a roller.

9. The system of claim 7, in which the sheet retarding device includes a one-way clutch adapted to allow the friction surface to travel in single direction.

10. The system of claim 7, in which the friction surface is on a belt and the belt is coupled to the drive cam that is adapted to cyclically move the belt to apply the alternatingly higher and lower force to the edge of the underlying sheet.

11. The system of claim 10, in which the drive cam is driven by a drive motor adapted to drive the sheet feeding head.

* * * * *